United States Patent [19]

Arciniega Blanco

[11] 4,301,733

[45] Nov. 24, 1981

[54] BULLET FOR SMOOTH BORE SHOTGUNS

[76] Inventor: Moisés Arciniega Blanco, Telemaco No. 18, Madrid 27, Spain

[21] Appl. No.: 32,106

[22] Filed: Apr. 20, 1979

[30] Foreign Application Priority Data

Apr. 22, 1978 [ES] Spain ..... 469.062

[51] Int. Cl.[3] ..... F42B 10/00

[52] U.S. Cl. ..... 102/513; 102/501; 102/448

[58] Field of Search ..... 102/92.1–92.5

[56] References Cited

U.S. PATENT DOCUMENTS

| | | | |
|---|---|---|---|
| 375,936 | 1/1888 | Harwood | 102/92.4 |
| 3,137,195 | 6/1964 | Rosenberg, Jr. | 102/95 X |
| 3,200,751 | 8/1965 | Vitt | 102/92.4 |
| 3,452,677 | 7/1969 | Abela | 102/92.4 X |
| 4,016,817 | 4/1977 | Blanco | 102/92.4 |
| 4,109,581 | 8/1978 | Six | 102/92.1 |

FOREIGN PATENT DOCUMENTS

| | | | |
|---|---|---|---|
| 665259 | 7/1965 | Belgium | 102/92.4 |
| 936110 | 11/1946 | France | 102/92.4 |

*Primary Examiner*—Harold J. Tudor

*Attorney, Agent, or Firm*—Wenderoth, Lind & Ponack

[57] ABSTRACT

A bullet for a smooth bore shotgun has a nose part preferably of metal and a base part preferably of plastic material. The two parts are assembled together, e.g. by engagement of a male projection on one of the parts into a female recess on the other of the parts.

20 Claims, 13 Drawing Figures

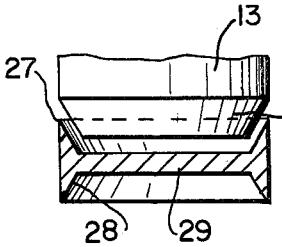
FIG. 7a
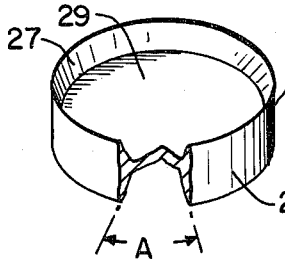
FIG. 7b
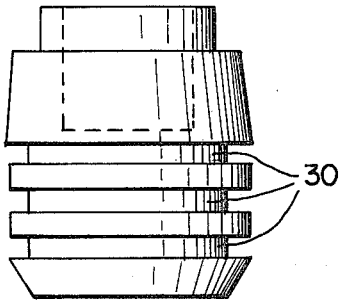
FIG. 8
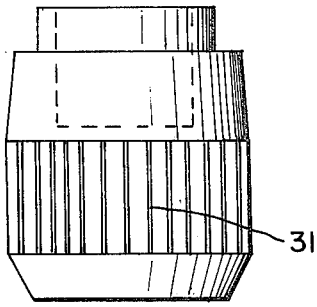
FIG. 9
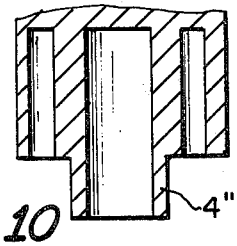
FIG. 10
FIG. 11
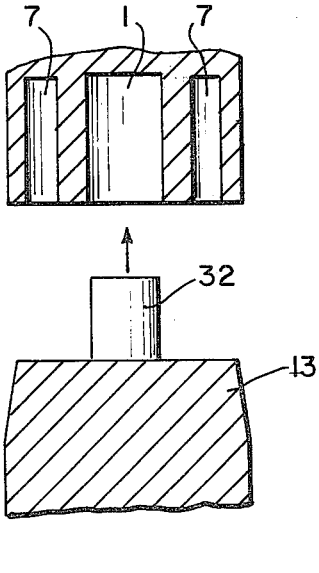

BULLET FOR SMOOTH BORE SHOTGUNS

BACKGROUND OF THE INVENTION

The present invention relates to improvements in the construction of bullets for smooth bore shotguns.

Various bullets or like projectiles for smooth bore shotguns have been known for some time and which are encased within a conventional casing and simply consist of bodies of lead, or similar metal, in the form of large, rough spherical elements, very heavy cylindrical bodies, which bear against the cork, base part, or filter, which seats against the explosive powder charge. This type of projectile has, in practice, been abandoned by manufacturers due to its technical shortcomings, in particular due to its excessive weight, the escape of the thrust gases involved by combustion of the powder charge, the fact that the centre of gravity in the body is not balanced, low velocity and accuracy, and for other reasons.

After the appearance of these early bullets, the German firm Brenneke developed, more than fifty years ago, an improved bullet consisting of a cylindrical lead body which had a blunt tip and whose outer surface was formed with helical ribs. The rear end of the lead body was attached to a felt plug and cardboard discs by means of a simple screw or rivet. This bullet developed by the firm Brenneke is still available and is used by the majority of loaders of cartridge bullets. Since the appearance of this Brennke-1920 bullet, other similar bullets and like projectiles have been designed, but have not afforded substantial advantages.

Another interesting and pertinent invention, made many years ago, was the bullet invented by the German firm Brennstoffwerk, of Schonebeck (Elbe). In this bullet the metal nose or head part, also based on the Brenneke-1920 bullet but with wider and deeper ribs, was attached to a plastic base part comprising a pin with disc-shaped plates serving to prevent escape of the gases. However, this assembly was heavy, and its disc-like plates were not compatible with good ballistics, as the shock of the air applied pressure and stress to its grooves. Like the Brenneke bullet, this cylindrical bullet rubbed against the walls of the gun barrel, reducing velocity and impairing the "shocks" or construction in the barrel of the gun. On the other hand, the above-mentioned German bullets have, around their blunt tip, a peripheral forward wall at their front end. In the case of some, more modern, bullets the lead part has been surrounded by a sheathing of plastic material so as not to affect adversely the gun barrel. However, the lethal efficacy is appreciably reduced due to the fact that they do not expand when hitting the target. In the case of other bullets separate (extraneous) bodies have been provided in the combined assembly of the head part (made of lead) and of the base part. Examples of these separate or extraneous parts are screw-threaded studs and nails of a harder metal, the outer surface of both of the bodies being provided with deep grooves and helical ribs, but these adversely affect the stability of the bullet in flight, render the article more expensive, and require more personnel for assembly.

Furthermore, both the Brenneke bullets and also those based on them (including the last-mentioned bullets) are subject to the drawback that the way in which the head (nose) body and the base body are joined together at the longitudinal pin—by means of a screw, rivets, screwthreaded stud, or some other separate element—results in oscillations and other disturbing movements being produced which affect the trajectory of the bullet. The better the centering, the more the difficulties increased. Independently of this, and as has already been stated, the provision of a screwthreaded stud, screw, or some similar attaching means, increases the price of the bullet, and assembly is more complicated.

It has been possible to demonstrate scientifically (making use of spark photography and supersonic tunnel tests) that the above-described types of bullet suffer from the serious defect—which is one amongst others and which cannot in any way be solved—that they do not have the correct movement of rotation when in flight, as the grooves of their outer surface do not direct the air, because they are too small in the case of some of these ribs, and due to their excessive height and increase of the angle of attack in the case of other ribs.

Also, it has been demonstrated that, when the angle of attack is increased by means of wide and deep grooves on the outer surface and also at the mouth of the gun barrel, the bullet or like projectile is rotated more quickly at supersonic speeds, whereas the bullet loses speed appreciably in the course of its flight towards the target when subsonic speeds have been reached. On the other hand, the increase in speed of rotation is not in any way equivalent to any significant improvement in the accuracy of the bullet (indeed, the contrary is the case), and this is truer still when the bullet is fired at a target lying at a distance of from 30 or 35 meters from the firearm. It is logical, as it is necessary, for obtaining a greater rotational velocity, to increase the helical angle, the depth of the grooves, and the height of the ribs, with in its turn, an increase in the angle of attack and the corresponding lateral stress or tension. To sum up, it is considered to be the case that the first-mentioned bullets suffer from the drawback of imperfect sealing, of too great a weight, of slow speed, of low stability, of low accuracy beyond a distance of a few meters, and of rendering the gun barrel unusable (smoothing out "shocks", pitting and wearing the tube). In addition the last-mentioned bullets (Brenneke-type, with small improvements in detail) entail the use of accessories which are extraneous to the body of the bullet for effecting mutual attachment of the nose part and base part of the bullet, the use of these extraneous accessories causing disturbances in the trajectory of the bullets. Also, the ribs of these bullets, whether these ribs are only small or are of pronounced size, usually do not impart correct rotational movement (doubt must be cast on the accessory nails, made of hard metal, and on the screwthreaded studs which are used, for the above-mentioned reasons and due to the fact that they are expensive, complicated, and unnecessary).

With a view to resolving the problems and shortcomings referred to above, and to obtaining advantages over the above-mentioned bullets (better range and penetration, better precision, higher speed and greater self-stabilising, greater ease in assembly, and saving in materials and labour, better sealing of the gases, and better protection of the barrel of the firearm), a composite bullet has been disclosed in a recent patent granted to the present inventor, which bullet consists of:

a metallic nose or head part, which is in the form of a single unit made by injection moulding of lead, including hardening, this nose part being of a novel shape or of a modified conventional shape. This incorporates the improvements of reduced weight, smaller diameter, a shape which is gently conical, aerodynamically satisfactory, and perfectly well stabilised, the greater weight being concentrated in the center axis of the front (impact) zone, and grooves and ribs being formed on the outer surface.

an intermediate thin disc or resilient ring made of lubricated felt, cork or fibrous material, which, in addition to serving as a damping or cushioning element, rubs against the bore of the gun barrel—due to the fact that the diameter of this disc is greater than that of the nose part of the bullet—and cleans the bore of impurities, oxides and powder residues, a rear part, which is made of plastic material, is also gently conical, and serves as a stabilising terminal or plug part and, in its front area, has a protuberance or stud which passes through the fibrous disc, so that it is retainingly lodged in the metal nose (head) part while it has, in its rear portion, a friction band, which conincides with the diameter of the bore of the gun barrel and acts as a friction zone; its rear end is concave, so as to constitute a peripheral rim or skirt for sealing off the gases.

These main characteristics for the bullets in the above-mentioned patent of the present inventor afforded—as tests carried out have demonstrated—important advantages over the previously known bullets. The value afforded by the advantages remains unaltered at the present time.

SUMMARY OF THE PRESENT INVENTION

Nevertheless, underlying the present invention is the object of simplifying and further improving the previous invention, reducing the manufacturing costs of such a bullet, rendering its assembly simpler, improving the weight distribution of the bullet and, above all, giving the bullet excellent aerodynamic shape, so as to make the bullet more effective in use, mainly insofar as the following aspects are concerned: its self-stabilising capability, its accuracy and range, at supersonic speeds, at the commencement of its path of travel, and at subsonic speeds after 25/35 meters of its path of travel. This is because, due to the advanced technology of the new explosive powders and rapid priming means, at the present time it is possible for bullets or like projectiles to travel at an initial speed, i.e. at the outlet or mouth of the gun barrel, of about 450/500 m.p.s. approximately (supersonic speed range), the bullets undergoing a deceleration in the course of their further path of travel such that, after about 25 meters, their speed decreases to about half the initial speed, that is to say to a speed of about 250/280 m.p.s. (subsonic speed; range).

It should be stated, for better understanding, that the speed of the bullet passes, by deceleration, from the initial supersonic speed range (i.e. a speed range of 450/500 m.p.s.) to the sonic speed range (340/350 m.p.s.) at usually about 10 meters from the mouth of the gun barrel. The speed of the bullet then passes to the transonic speed range (315/325 m.p.s.), which is referred to as the "bad zone" in which vibration and lateral stresses (tension) are set up. This speed range is entered usually at 15/20 meters from the mouth of the gun barrel. Finally, the speed of the bullet typically reaches the subsonic range of speeds (i.e. speeds below 300 m.p.s.) after 25/30 meters from the mouth of the gun barrel. Consequently, the bullet must have an ideal aerodynamic shape for passing from the initial or supersonic speed range to the subsonic speed range (after 25 meters of the path of travel of the bullet).

The present invention provides an improved bullet with a shape suitable for passing from supersonic to sonic, transonic and then subsonic speed. This ideal compound (mixed) shape is a function of the characteristics of a nose part preferably of metal and of a base part preferably of plastic of the bullet. The base part serves as a stabilising end or plug part.

The simplification and consequent saving in materials and in labour in assembly, achieved through the use of the present invention, will be understood simply from the fact that the preferred bullet assembly is solely constituted by two parts, i.e. the metal nose part and the plastic base part, both of which can be made by injection moulding of the respective material of which the two parts are to be made. These two parts are attached to one another without any need to use separate (extraneous) accessories or components (nails, screws or the like). Indeed, one of these two parts is inserted in the other by moving the two parts towards one another, a male surface on one of these two parts and a female surface on the other of the two parts being locked together through exertion of pressure.

The metal nose part is suitably constituted by a cylindrical body or trunk which is gently conical, and is of an appropriate length (greater than its diameter). Extending from the front portion of this nose part there is preferably a conical tip which will oscillate between 1.5 and 1.8 Mach numbers (24th to 40th). This speed of oscillation is very suitable for initial supersonic flight (450 to 500 m.p.s.). Nevertheless, depending on the explosive charge employed, the tip can be of ogival or generally semicircular shape, if the desired speed of the bullet lies within sonic and subsonic ranges.

The metal nose part conveniently has at its rear end either a recess or hollow (for receiving a stud-like attachment portion of the plastic base part) or, more preferably, a small-diameter extension in the centre of its base, this extension being cylindrical or conical and, where appropriate, tubular, with retaining means for its introduction into a recess in the plastic base part. The extended portion constitutes a longitudinal pin which imparts greater stability, the greater weight being concentrated in the front portion of the nose part. In this way good flight stability can be imparted to the bullet assembly, with proper positioning of the longitudinal pin or shank, which is centred and with the greater part of the weight in the front portion, a centre of gravity thereby being achieved which can result in an advantageous self-stabilising effect.

In this last case, and for reducing the weight of the body and distribution of the weight, an annular recess will usually be formed, at the rear end, round the central extension referred to above.

With regard to the rotary movement of bullets (for smooth bore firearms), it has been shown that is it not necessary as it is not possible specifically to calculate what would be correct; nor can it be obtained by means of helical outer ribs. Nevertheless, in the present bullet, it is envisaged that the metal nose part (made from injection moulding, preferably of lead hardened with antimony or some suitable alloying agent) will preferably carry, at its outer surface and of variable number, a plurality of small longitudinal ribs, which taper to a point and extend at an inclined angle. Such ribs can prevent excessive pressure being set up and will in effect reduce the weight of the assembly. Thus in a preferred construction the ribs are distributed uniformly and regularly over the surface of the cylindrical/conical trunk, and their height or radical thickness decrease from the front tips or ends to their near ends for achieving the minimum or smallest angle of attack in receiving the effects of air impact. The front edge or portion of each rib tapers to a point and its maximum height should be controlled (not very small, nor very pronounced, as in other known bullets), so as not to increase, as has been stated, the angle of attack and the lateral tensions, which would disturb the stability of the bullet and consequently, its trajectory. For this, the maximum height of the ribs should not exceed 1 to 1.3 mm, this height gradually decreasing until it reaches a value of zero at the opposite end of the ribs. It is also convenient if these ribs are narrow at the front ends or edges and progressively widen towards their rear ends.

The ribs should not be very numerous, so as to prevent the channels being very narrow and, consequently, to avoid escape of the air. By way of example, a suitable number of these ribs would be light, thereby defining this number of channels, with free rear ends.

The preferred complementary base part, made from injection moulded plastic material and somewhat flexible, comprises a cylindrical/conical body, with a smooth outer surface, which, at its front portion, has a diameter which coincides with that of the rear end of the rear portion of the nose part. This diameter progressively increases until it coincides, at its medium/rear portion, with the diameter of the bore of the firearm, by virtue of which this rear zone will act as a friction band within the bore of the barrel of the firearm, so as to avoid shocks and other adverse movements of the bullet assembly in the walls of the firearm barrel during the passage of the bullet assembly towards the outside of the firearm. This friction band can have two or three annular grooves or slight vertical ribs for reducing the pressure of the bullet assembly within the bore of the firearm.

According to a further embodiment of the invention there is formed, in the front end of the base part, a prolongation or protuberance, which may be solid or tubular and which serves to attach together, through the exercise of pressure, the two parts of the bullet assembly. Such attachment is effected by moving the two opposed ends of these parts of the assembly towards each other, i.e. in opposite directions, until the means provided for anchoring or locking them together engage in one another, the use of any extraneous elements for this purpose is thereby dispensed with.

Another very important and virtually essential characteristic for preferred bullets of this invention resides in an edge chamfer formed approximately in the rear third of the base part and defining a conical portion which reduces the aerodynamic resistance at subsonic speeds. A balance is then achieved at supersonic and subsonic speeds, and the bullet is given an improved range and accuracy. For preventing any escape of gas at this conical rear portion there can be provided, separate and between the bullet assembly and the powder charge, a known resilient disc with an expansion and sealing flange at its lower end, this resilient disc serving at the same time as a thrust bearing.

If it is desired to obtain an improved expension of the bullet, provision is made for introducing, into the tubular recess of the nose piece, a small calibrated element of hard metal, so that the lead nose part will disintegrate when the bullet strikes against the target.

BRIEF DESCRIPTION OF THE DRAWINGS

Other objects, features and advantages of the invention will be apparent from the following description of preferred embodiments, which embodiments are non-limiting and exemplary only of the invention, with reference to the accompanying drawings, wherein:

FIGS. 7*a* and 7*b* are, respectively, an elevation view of a lower conical portion of a nose part seating in an expansion ring, and a perspective view, partially in section, of the ring to show the profile of the ring;

FIG. 8 is an elevation view of a base part, similar to that of FIG. 2, but which has annular grooves formed in its surface, thus defining a friction portion;

FIG. 9 is an elevation view of a base part similar to that of FIG. 8, but which is formed with vertical ribs for the friction portion;

FIG. 10 is a partial section of the lower portion of a metal nose part with a tubular pin or shank which is extended and which has smooth walls; and FIG. 11 is an exploded view, in longitudinally section, of nose and base parts of a bullet of the invention adapted to be attached to one another through engagement of a lug of the base part in a recess of the nose part.

DETAILED DESCRIPTION OF THE INVENTION

The invention will now be described with reference to the drawings wherein like parts and components in the various figures are denoted by like numerals.

The invention is principally concerned with the distinctive combination of an assembly constituted by a metal head part 1 of conical/cylindrical shape and by a plastic nose part 13, also of conical/cylindrical shape.

Figure 1:
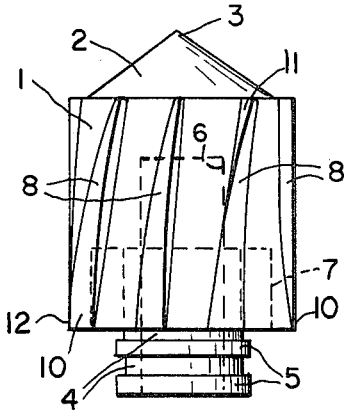
FIG. 1 is an elevation viw of a metallic nose part of a bullet according to the invention, the nose having a pointed or conical tip.
Figure 3:
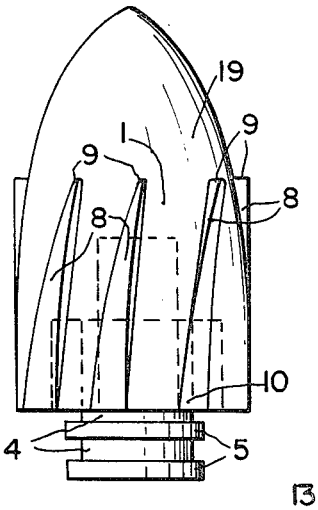
FIG. 3 is an elevation view of a nose part which is of ogival shape.
Figure 4:
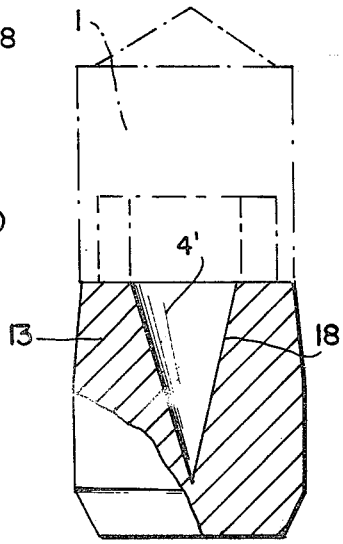
FIG. 4 is an elevation view showing a nose and base part assembled together to form a bullet of the invention, the base part being partially sectioned to reveal a conical prolongation of the metal nose part.
Figure 5A:
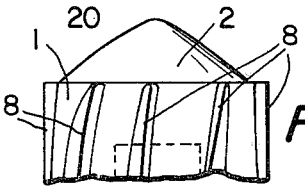
FIG. 5*a* and 5*b* are, respectively, a side view of the upper portion of a metallic nose part of a bullet, the tip being semi-circular, and a plan view thereof.
Figure 5B:
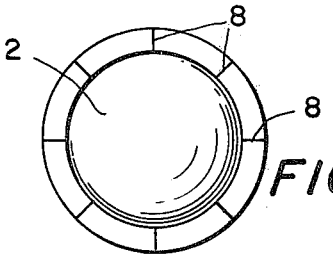

The metal body of the nose part 1 has a front impact end 2 which may be conical 3 (FIG. 1), ogival 19 (FIG. 3), or semi-circular or generally rounded 20 (FIG. 5) according for instance to the explosive charge of the cartridge employed. Extending from the rear end of the nose part is a tubular portion 4 having retaining means such as rings 5 and a central recess or hollow 6 (FIG. 1). This downwardly extended tubular portion is provided for introduction into a central recess of a base part 13 of the bullet. If appropriate, the downwardly extending portion may be given conical shape 4' so that it can engage in a recess 18 as shown in FIG. 4. This downwardly prolonged portion may also be tubular (as shown at 4) but without the retaining or locking means 5, that is to say this downwardly prolonged portion will have a smooth wall 4", so that it can be locked to its cooperating part simply through exercising pressure (FIG. 10).

A number of thin ribs 8 extend along the outer surface of the conical/cylindrical nose part. These ribs 8 are uniformly and regularly distributed round the surface of the nose part 1 and are inclined at a small angle. The ribs 8 are greater in distance from the outer surface of part 1 or height 11 at the front end than at the rear end 12, of the part i, and end at zero height at end 12 (FIG. 1). Also, each of the ribs tapers to a point at its front end 9 and continuously widens towards its rear end 10 (FIG. 3).

An annular recess 7 is formed at the lower end of the metal nose part 1 with a view to reducing the weight of the bullet assembly and to concentrate the weight at the central/upper portion of nose part 1. The recess 7 lies between the wall of the nose part 1 and the wall of the central protuberance 4, 4' or 4".

Figure 6:
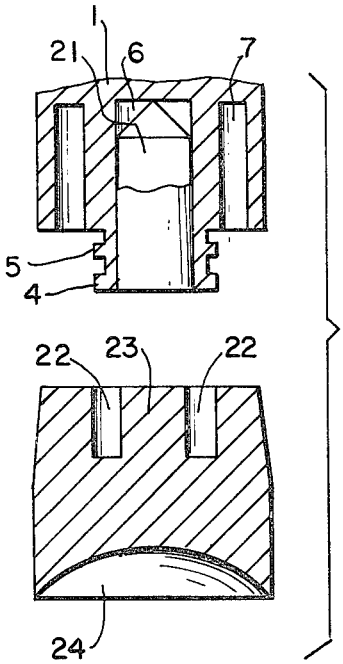
FIG. 6 is an exploded view, in section, of part of the length of a metal nose part and a plastic base part of a bullet of the invention, the nose and base parts being shown positioned opposite one another and in vertical cross-section, means for locking the parts together also being shown.

FIG. 6 illustrates an embodiment in which the bullet can be expanded. For this purpose a calibrated element 21, which is made of a metal harder than that of the base part 1, is inserted into the interior or recess 6 of the tubular protuberance.

The complementary base or rear part 13, made of plastic material, has a front conical portion 14 followed by another, cylindrical zone 15, which constitutes a friction band, this cylindrical zone 15 ending, at its lower end, in a chamfer 16 of very steep angle. This chamfered portion is seated on the bottom 29 of a disc 26, which has an upper receiving or seating surface 27, and a lower flange 28, which serves to seal off gases.

Figure 2:
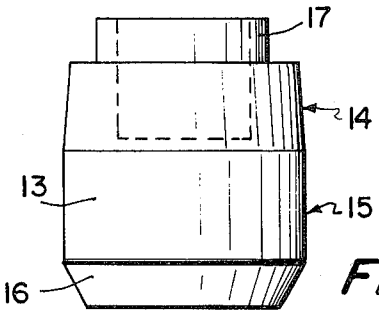
FIG. 2 is an elevation view of the rear or base part employed with the nose portion of FIG. 1.

The friction band 15 of the base part 13 of the bullet is intended to reduce the pressure by means of a number of annular grooves 30 (FIG. 8) or a number of longitudinal ribs 31 (FIG. 9). At the upper end of the base part 13 is a tubular protuberance 17 (FIG. 2) or solid protuberance 32 (FIG. 11) which can be inserted, through the exercise of pressure, into the metal nose part 1 of the bullet. According to a modification of the invention the base part 13 has formed at its upper end an annular recess 22 which defines a central stud 23 (FIG. 6), which can engage in the hollow interior 6 of the nose part 1, while its lower end is formed with a cavity 24 defining an edge in which the gases can expand, and which seals off these gases.

I claim:

1. A bullet of the type for use in a smooth bore shotgun, said bullet comprising:

a metal nose part having a forward tip end, a rear end and a trunk joining said tip and rear ends, said trunk having uniformly circumferentially distributed around the outer surface thereof a plurality of ribs inclined to the longitudinal direction of said nose part, each said rib having a forward end and a rear end, the radial thickness or height of each said rib having a maximum at said forward end thereof and continuously decreasing to zero at said rear end thereof;

a plastic base part having a forward end and a rear end, said base part having adjacent said forward end a conical portion widening from said foward end, and said base part having a cylindrical portion joining said conical portion and extending therefrom toward said rear end; and means for tightly joining said nose part to said base part solely by means of friction fit therebetween, said joining means comprising a male projection extending from one of said nose part or said base part and a female recess provided in the other of said nose part or said base part, said projection and recess being dimensioned such that said projection is tightly received within said recess upon pressing of said nose part and said base part together.

2. A bullet as claimed in claim 1, wherein each said rib tapers from a widest portion at said rear end to a point at said forward end.

3. A bullet as claimed in claim 1, wherein said tip end of said nose part is conical.

4. A bullet as claimed in claim 1, wherein said tip end of said nose part is rounded.

5. A bullet as claimed in claim 1, wherein said trunk of said nose part smoothly joins said tip end of said nose part, and said tip end is ogival.

6. A bullet as claimed in claim 1, wherein said nose part is formed of a lead alloy.

7. A bullet as claimed in claim 1, wherein said base part has adjacent said rear end thereof a chamfered portion for reducing aerodynamic resistance of the bullet at subsonic speeds.

8. A bullet as claimed in claim 7, further comprising a disc-shaped thrust bearing adapted to be positioned between said base part and an explosive charge, said thrust bearing having a forward flange adapted to engage said chamfered portion of said base part and a rearward flange adapted to seal off gases resulting upon firing of the charge.

9. A bullet as claimed in claim 1, wherein said cylindrical portion of said base part has therein plural circumferentially extending annular grooves.

10. A bullet as claimed in claim 1, wherein said cylindrical portion includes a plurality of longitudinally extending ribs.

11. A bullet as claimed in claim 1, wherein said rear end of said base part has therein a cavity.

12. A bullet as claimed in claim 1, wherein said projection extends from said rear end of said nose part, and said recess is in said forward end of said base part.

13. A bullet is claimed in claim 1 or claim 12, wherein said projection is tubular.

14. A bullet as claimed in claim 3, wherein said recess is annular.

15. A bullet as claimed in claim 3, wherein said tubular projection has on the outer surface thereof at least one annular retaining ring.

16. A bullet as claimed in claim 1 or claim 12, wherein said projection is cylindrical.

17. A bullet as claimed in claim 1 or claim 12, wherein said projection and said recess are conical.

18. A bullet as claimed in claim 12, wherein said projection has an internal axial recess, and further comprising an expansion element positioned within said axial recess, said expansion element having a pointed tip of a metal harder than the metal of said nose part.

19. A bullet as claimed in claim 1, wherein said projection extends from said forward end of said base part, and said recess is in said rear end of said nose part.

20. A bullet as claimed in claim 19, wherein said projection is cylindrical.

* * * * *